United States Patent [19]

Ragettli

[11] 3,930,593

[45] Jan. 6, 1976

[54] CONTAINER (OR VESSEL) WITH A COVER

[75] Inventor: Christian Ragettli, Gockhausen, Switzerland

[73] Assignee: Koninklijke Emballage Industrie van Leer B.V., Amstelveen, Netherlands

[22] Filed: July 17, 1973

[21] Appl. No.: 380,052

[30] Foreign Application Priority Data

July 21, 1972 Netherlands ..... 10164/72

[52] U.S. Cl. ..... 220/276; 220/270

[51] Int. Cl.[2] ..... B65D 17/00

[58] Field of Search ..... 220/27, 53, 54, 48, 276, 220/270

[56] References Cited

UNITED STATES PATENTS 3,120,321 2/1964 McCuskey et al. ..... 220/54

3,425,596 2/1969 Vogel ..... 220/54

*Primary Examiner*—George E. Lowrance
*Assistant Examiner*—Steven M. Pollard
*Attorney, Agent, or Firm*—Stevens, Davis, Miller & Mosher

[57] ABSTRACT

A container having a cover, the container having a rim and a first curled edge at the rim, a portion of the first curled edge having its biggest diameter in a plane perpendicular to the center line of the container, the cover having a second curled edge gripping around the first curled edge, the second curled edge including a circumferential cutting line which flows up and down with peaks at a region of or above the portion of the first curl having the biggest diameter and with valleys underneath the portion.

2 Claims, 5 Drawing Figures

CONTAINER (OR VESSEL) WITH A COVER

The present invention relates to a container having a cover, said cover having a curled edge and gripping around a curled edge or thickening at the rim of the container. Containers of this kind are generally known. In many cases they are bucketshaped in order to be able to nest the open containers for dispatch and storage to the installation or the plant where the filling takes place, whereupon the filled container is closed with a cover by folding or seaming respectively the edge of the cover around the rim of the container. Usually, one makes use of a clamping device, which, after positioning the cover onto the container, is positioned on top of cover and container and which bends down the edge of the cover underneath the edge of the container with clamping means moving inwards and downwards in a radial direction. Moreover, the cover is usually provided with an opening with a locking cap so that the emptying of the container is made possible. It is also known to provide the cover on the inside of the container wall, i.e. inwards of the edge of the cover folded around the rim of the container, with a cutting line in the form of a thinned portion, where the cover may be cut through easily with a tool suitable therefore.

Emptying the container through a small opening with the locking cap is often cumbersome. The empty container cannot be nested and removing the cover and the remaining edge respectively is cumbersome. If the cover is cut away, the container cannot be closed anymore.

It is also known to provide container of this kind with a cover which may be fastened in place with a clamping strap. Such a cover may be used again. However, the clamping strap is an additional complication and the sealing is not always effective.

The object of the present invention is to provide a container, in which the cover permits a good liquid tight closure on the container, in which said cover can be removed easily and in which the cover can be used again as a temporary cover after removal.

Said object is achieved in accordance with the invention in that the cover is provided in the curled edge with a circumferential cutting line, said line extending up and down in accordance with a flowing line with the peaks at the region of or above that portion of the curl of the edge of the container which has the biggest diameter in a plane perpendicular to the center line of the container and with the valleys underneath said portion. In this way, a cover is formed which may be provided in a normal way by curling or folding around the thickened or curled rim of the container and which guarantees a proper sealing in a known way by an enclosed gasket. Said cover may be removed by tearing off the lower portion of the curled or bent edge, during which process a new edge is formed lying locally above the biggest diameter or at the level of the biggest diameter of the edge of the cover and locally below said diameter, as a consequence of which lugs or tongues are formed on the cover, said lugs or tongues lying downward at regular distances from each other and still gripping around the edge of the vessel. However, they are now yielding because the rigidity has been broken in the circumferential direction and they permit upward removal of the cover as well as putting the cover back again, whereby the lugs or some of them, eventually may be bent inwards to keep the lid on its place. Preferably the cutting line comprises a first groove at the outer side of the beaded edge and a second groove at the inner side of the beaded edge, said second groove lying in alignment opposite to the first groove. Consequently the edge will be very sharp.

The invention will now be explained more in detail with reference to the accompanying drawing which illustrates by way of example one embodiment of the invention, wherein.

Figure 1:
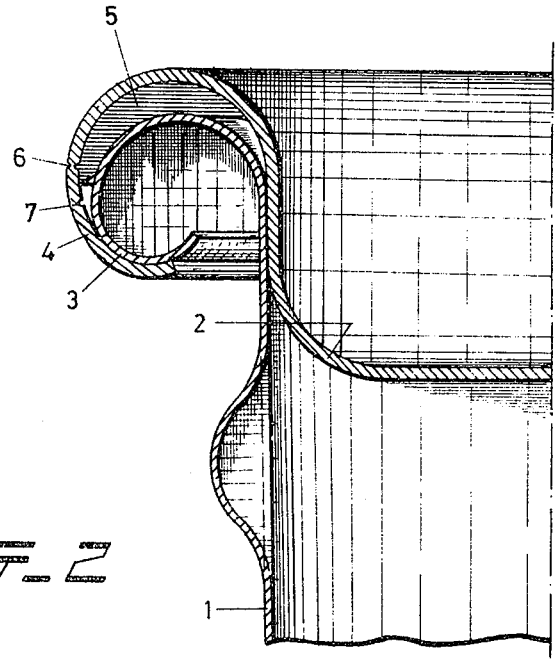
FIGS. 1 and 2 are sectional views across a beaded edge of a container and a lid secured on the vessel.
Figure 2:
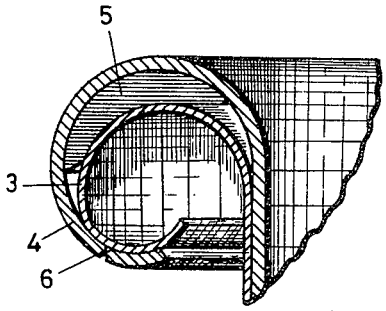
Figure 3:
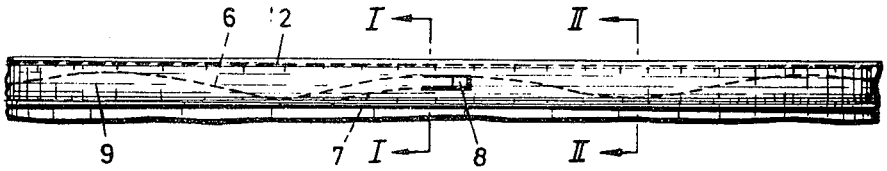
FIG. 3 is a side view of the edge of the lid to a slightly smaller scale.

The container 1 has a cover 2 and is provided at the rim with an edge 3. The cover is provided with an edge 4. Both edge portions 3 and 4 together are rolled into each other to an open curl by a folding or bending operation. A sealing is indicated at reference numeral 5. Reference numerals 6 and 7 indicate cutting lines. As appears from FIG. 3, the cutting line 6 extends according to a sinusoidal line, the position of the peak of which is indicated in FIG. 1, and in FIG. 2 the position of the lower portion. The cutting line 7 is a short line extending in the lower edge. At reference numeral 8 an opening or lug is provided so that the initial tearing off is made possible. The cross-section of FIG. 1 has been taken according to line I—I in FIG. 3

Figure 4:
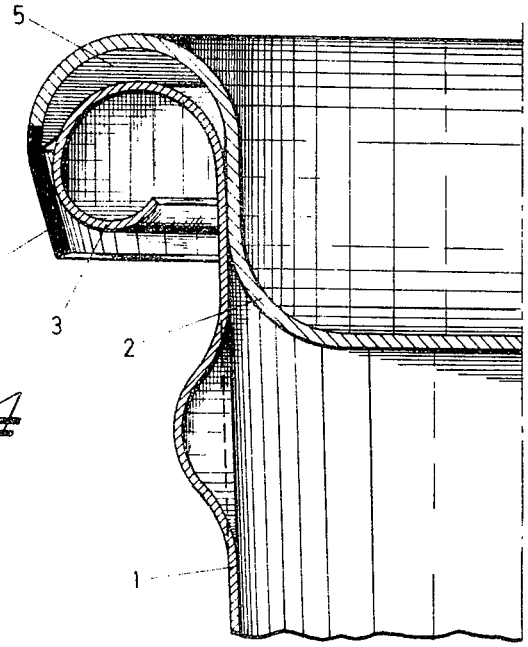
FIGS. 4 and 5 are sectional views in accordance with FIGS. 1 and 2, and in which the edge has various shapes after the opening of the container.
Figure 5:
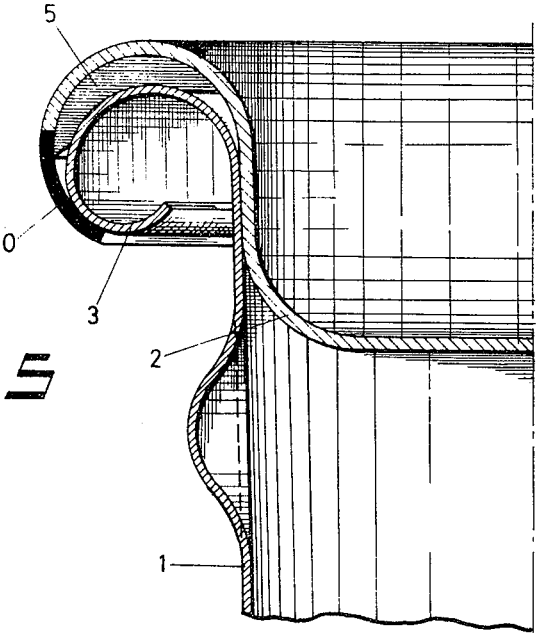

FIGS. 4 and 5 illustrate the situation after tearing off the strip 9. The edge in waveform will then form lugs 10 which, in the position as indicated in FIG. 4, permit removal of the cover and which, in the position as indicated in FIG. 5 have been bent inwards in order to hold the cover in place again.

What we claim is:

1. A container having a cover, said container having a rim and a first curled edge at said rim, a portion of said first curled edge having its biggest diameter in a plane perpendicular to the center line of the container, said cover having a second curled edge gripping around said first curled edge, said second curled edge including a circumferential cutting line which flows up and down with peaks at a region of or above said portion of said first curl having the biggest diameter and with valleys underneath said portion.

2. A container having a cover in accordance with claim 1 wherein said cutting line comprises a first groove at the outer side of said second curled edge and a second groove at the inner side of said second curled edge, said second groove lying in alignment opposite to said first groove.

* * * * *